United States Patent [19]

Liedtke et al.

[11] Patent Number: 5,008,792

[45] Date of Patent: Apr. 16, 1991

[54] DEVICE FOR LOCKING AN OPTICALLY TRANSPARENT TROUGH TO A HOUSING OF AN EXTENDED-FIELD LIGHT

[75] Inventors: Heinz Liedtke, Dortmund; Cornelius Ploeger, Fröndenberg-Frömern; Wilmut Görner, Mudau, all of Fed. Rep. of Germany

[73] Assignee: ABB CEAG Licht- und Stromversorgungstechnik GmbH, Soest, Fed. Rep. of Germany

[21] Appl. No.: 499,027

[22] Filed: Mar. 26, 1990

[30] Foreign Application Priority Data

Mar. 25, 1989 [DE] Fed. Rep. of Germany ..... 3909890

[51] Int. Cl.[5] ..... F21V 21/00

[52] U.S. Cl. ..... 362/374; 362/223

[58] Field of Search ..... 362/223, 311, 329, 374, 362/375

[56] References Cited

U.S. PATENT DOCUMENTS

| | | | |
|---|---|---|---|
| 3,549,879 | 12/1970 | Meyer | 362/223 |
| 4,039,820 | 8/1977 | Materese | 362/223 |
| 4,580,200 | 4/1986 | Hess et al. | 362/223 |

FOREIGN PATENT DOCUMENTS

| | | |
|---|---|---|
| 0226894 | 7/1987 | European Pat. Off. . |
| 1944376 | 4/1966 | Fed. Rep. of Germany . |
| 2064443 | 7/1972 | Fed. Rep. of Germany . |
| 3633351 | 4/1988 | Fed. Rep. of Germany . |
| 335380 | 2/1959 | Switzerland . |

*Primary Examiner*—Stephen F. Husar

*Attorney, Agent, or Firm*—Herbert L. Lerner; Laurence A. Greenberg

[57] ABSTRACT

A device for locking an optically transparent trough of an extended-field light to a housing includes a slider element, which can be actuated manually from the ouside and which is longitudinally displaceably guided in the housing, for actuating connecting elements connecting the trough to the housing. At least one respective inwardly projecting projection is disposed at edges of the trough and the housing which are adjacent and one above the other. The projections are disposed and oriented in the same direction and parallel to one another, so that they are situated one above the other in the assembled condition of trough and housing. A grip is coupled with the slider element for each pair of projections. The jaws of the grip receive the pair of projections between them, as soon as the slider element is displaced from the releasing position into the locking position.

6 Claims, 2 Drawing Sheets

DEVICE FOR LOCKING AN OPTICALLY TRANSPARENT TROUGH TO A HOUSING OF AN EXTENDED-FIELD LIGHT

The invention relates to a device for locking an optically transparent trough of an extended-field light to a housing with a slider element, the slider element being manually displaceable from the outside and longitudinally displaceably guided in the housing, for actuating means for connecting the trough to the housing.

In the assembled condition, the housing and the trough together with fluorescent lamps and further components form an extended-field light. In order to achieve increased safety (see VDE specifications) a seal is situated between the longitudinal edges of the housing and the trough. The two edges of the trough and the housing are pressed against one another by means of a locking device which can be actuated manually from the outside.

For this purpose, a slider element is situated within the housing, at the floor thereof. The slider element is displaceable in its longitudinal direction or in the longitudinal direction of the extended-field light. Hooks which engage behind pins on the trough, are fitted to the slider element. The problem which such a device is that the sealing force cannot always be maintained at a specified magnitude.

It is accordingly an object of the invention to provide a device for locking an optically transparent trough with a housing of an extended-field light, which overcomes the hereinafore-mentioned disadvantages of the heretofore-known devices of this general type and with which the sealing force can always be maintained at a specified magnitude.

With the foregoing and other objects in view there is provided, in accordance with the invention, a combination, comprising an optically transparent trough of an extended-field light, a housing, and a device for locking the trough to the housing, the trough and the housing each having a respective mutually adjacent edge disposed one above the other and at least one respective inwardly projecting mutually parallel projection disposed at the edge being oriented in the same direction and disposed one above the other in an assembled condition of the trough and the housing forming at least one pair of projections, and the locking device including a slider element being manually longitudinally displaceably guided in the housing between a releasing position and a locking position from outside the housing, and at least one grip each being coupled with the slider element for each pair of projections, the at least one grip having jaws receiving the pair of projections therebetween upon displacement of the slider element from the releasing position to the locking position.

In this case, there are two possibilities:

In accordance with another feature of the invention, the grip or grips can be formed or shaped onto the slider element. This means that the surfaces of the jaws which face one another are inclined, at least in the direction of sliding, in such a manner that the spacing between them in the direction of sliding varies. As a result of this, the two jaws are wedge-shaped at the mutually opposite sides thereof and enclose an acute angle between them, as seen in the direction of sliding. In this case, the angle is open in the direction of sliding, so that when the two jaws are pushed over the projections, the projections are pressed against one another and the sealing force is generated due to the wedge-shaped sloping of the jaws.

In accordance with a further feature of the invention, the the jaws are inclined transversely to the direction of displacement, so that the grip is open in the grip opening direction. As a result of this, a skew-like configuration of the two surfaces facing one another is achieved and tolerances can also be compensated for transversely to the direction of sliding.

In accordance with a concomitant feature of the invention, the grip is fitted to a locking element which is rotatable within the housing about an axis extending in the direction of the extent of the seal. In these circumstances, a control link is provided, in addition on the slider element, for pressing the slider transversely to the direction of sliding over the two projections.

Other features which are considered as characteristic for the invention are set forth in the appended claims.

Although the invention is illustrated and described herein as embodied in a device for locking an optically transparent trough with a housing of an extended-field light, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
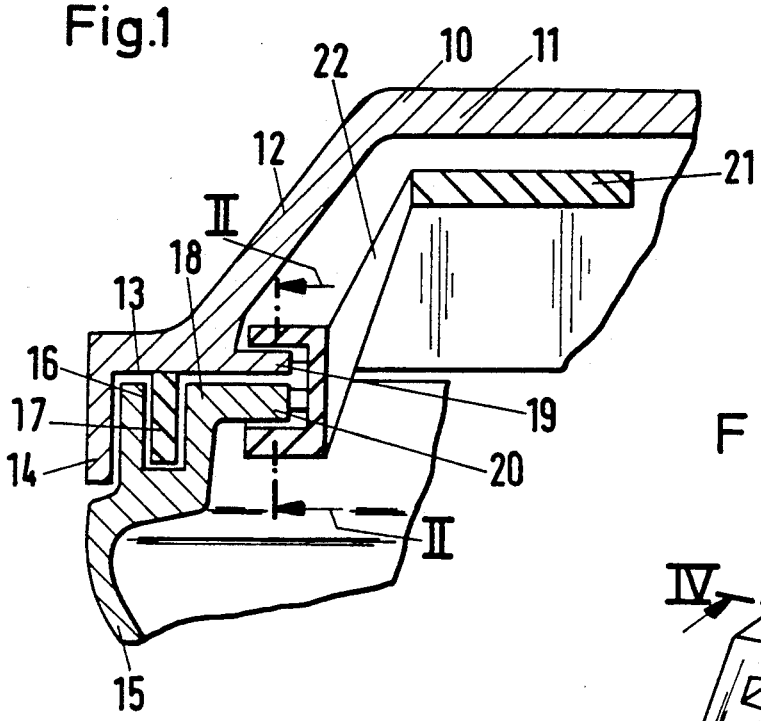
FIG. 1 is a fragmentary, diagrammatic, longitudinal-sectional view of an extended-field light, taken along the line I—I of FIG. 2, in the direction of the arrows.

Referring now to the FIGURES of the drawing in detail and first, particularly, to FIG. 1 thereof, there is seen an extended-field light having a housing 10 with a floor part 11 and two side walls, of which only a side wall 12 is shown. A sealing surface 13 and an edge portion 14 extending perpendicular to the floor part 11 are provided at the edge of the side wall 12. The extended-field light further includes an optically transparent trough 15, which has a circulating groove 16 at the free edge thereof. A seal 17 disposed in the circulating groove 16 acts against the sealing surface 13 in the closed condition of the extended-field light.

A projection 19 is provided with an extension of the sealing surface 13 at the internal surface of the free edge, in this case the free edge of the housing 10. A projection is also provided at an inner leg 18 of the trough 15. The number of projections corresponds to the number of locking elements, which will be further explained below.

Figure 3:
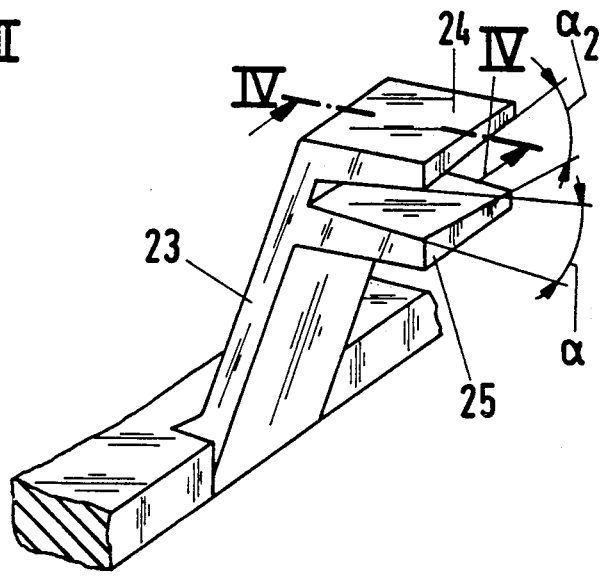
FIG. 3 is a fragmentary, perspective view of a grip-like locking element.
Figure 2:
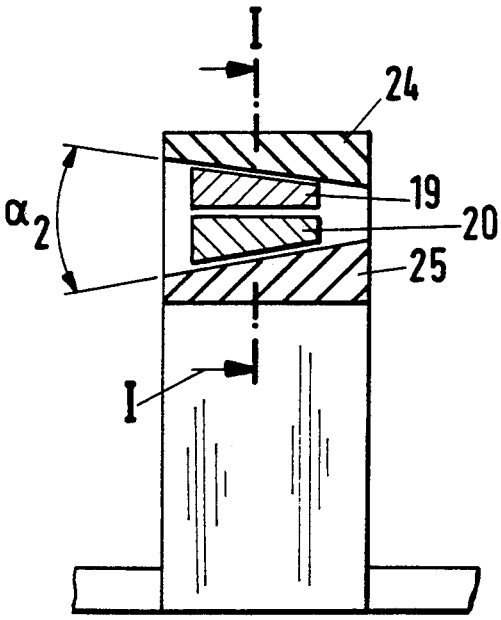
FIG. 2 is a fragmentary, longitudinal-sectional view taken along the line II—II of FIG. 1, in the direction of the arrows.
Figure 4:
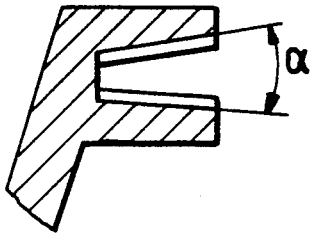
FIG. 4 is a fragmentary, longitudinal-sectional view taken along the line IV—IV of FIG. 3, in the direction of the arrows.

A slider element 21 is displaceably guided at the floor part 11 and parallel thereto, in the direction of the longitudinal direction of the extended-field light, between a releasing position and a locking position. A plurality of locking elements 22 are formed on the longitudinal edges of the slider element 21. In the embodiment according to FIGS. 1 to 3, the locking elements 22 each have a web 23, which extends at an angle relative to the slider element 21 and on which two jaws 24 and 25 are formed in the shape of a grip. In this case, the two limbs or jaws 24, 25 form an U which is outwardly open transversely to the longitudinal direction of the slider element 21. The internal surfaces of the jaws are inclined over the extent thereof in the longitudinal direction, i.e. transversely to the slider element 21, so that an open wedge with an acute angle alpha is formed by the jaw lines at that location In addition, the jaws 24 are also inclined in the direction of displacement, so that an angle $alpha_2$ which is open in the direction of displacement is formed, as seen in FIG. 2 and FIG. 4. The two projections 19 and 20 can then be inclined in the same direction and approximately parallel at the oppositely disposed surfaces thereof, like the internal surfaces of the two jaws 24 and 25, so that the jaws receive the pair of projections therebetween upon displacement of the slider element from the releasing position to the locking position.

Figure 5:
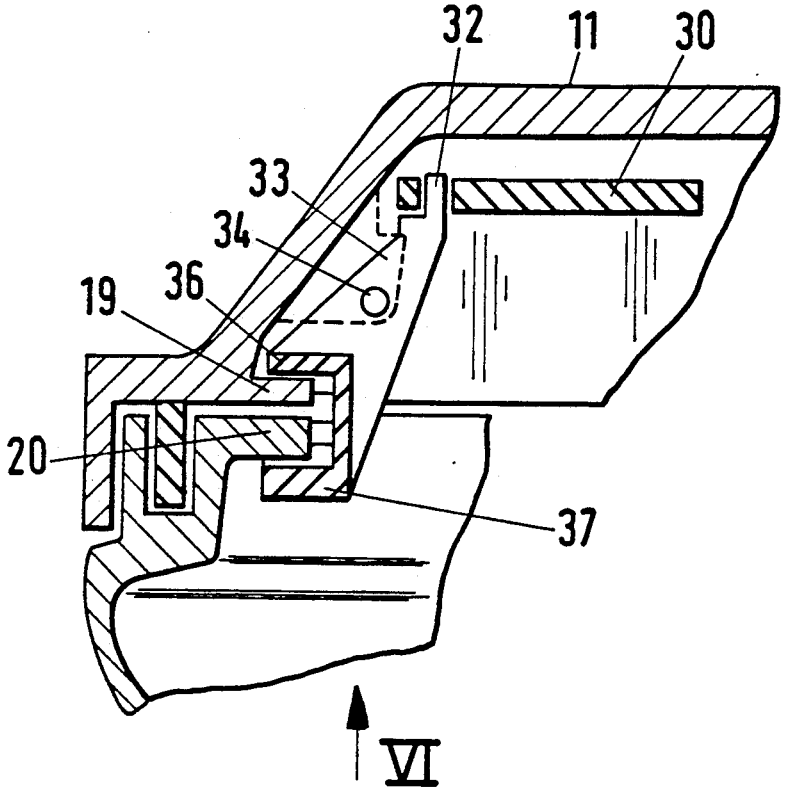
FIG. 5 is a fragmentary, longitudinal-sectional view of another embodiment of the device taken along the line V—V of FIG. 6.
Figure 6:
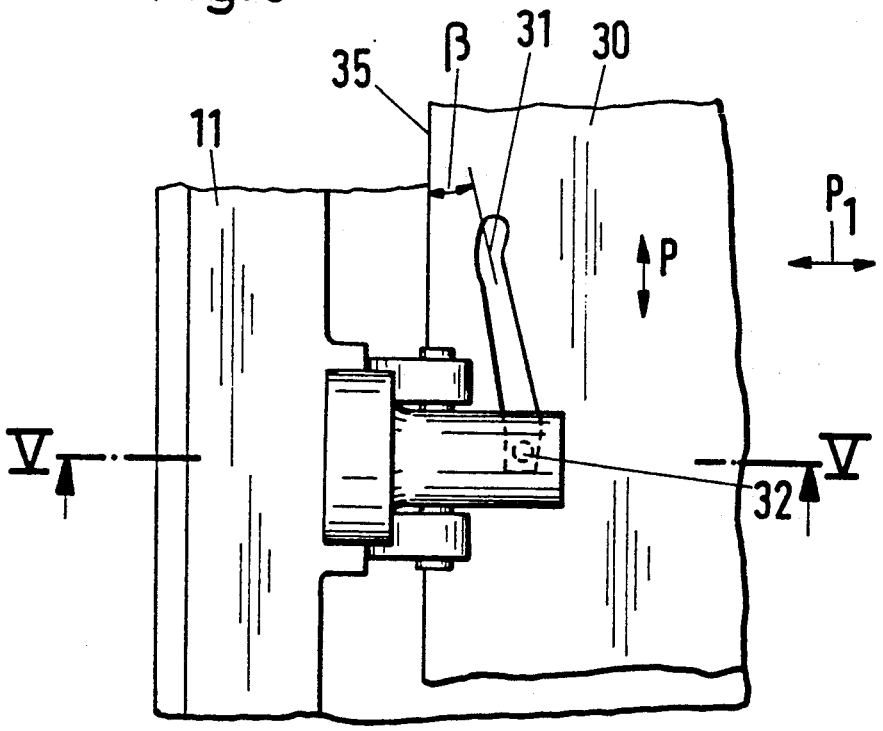
FIG. 6 is a fragmentary, bottom-plan view taken along the direction of the arrow VI in FIG. 5.

Regarding the embodiment of FIGS. 5 and 6 there is, of course, also the possibility of providing a slider 30 in which grooves 31 are formed. The grooves 31 form a link disposed at the slider element for pivoting a locking element 33 into and out of a locking position. A pin 32 of the locking element 33 engages in the grooves 31. The locking element 33 is mounted on the housing approximately at the center thereof, on an axis of rotation 34. In this case, the longitudinal extent of the axis of rotation on one side points in the same direction as the longitudinal extent of the slider or the direction of displacement or the longitudinal extent of the sealing surface.

The groove 31 in the slider element 30 is oriented at an angle beta relative to a longitudinal edge 35, so that when the slider or the slider element 30 moves in the direction of an arrow P, the pin 32 is pivoted transversely into the direction of the arrow P, i.e. transversely to the direction of displacement, outwards or inwards, so that jaws 36 and 37, which are formed onto the locking element and which correspond to the jaws 24 and 25, are accordingly moved over the two projections 19 and 20 or away from the two projections. For this purpose, the internal surfaces of the two jaws 36 and 37 are inclined in the direction of pivoting and are opened, as seen by the angle alpha between the two jaws 24 and 25 of FIG. 3.

We claim:

1. An apparatus comprising an optically transparent trough of an extended-field light, a housing, and a device for locking said trough to said housing, said trough and said housing each having a respective mutually adjacent edge disposed one above the other and at least one respective inwardly projecting mutually parallel projection disposed at said edge being oriented in the same direction and disposed one above the other in an assembled condition of said trough and said housing forming at least one pair of projections, and said locking device including a slider element being manually longitudinally displaceably guided in said housing between a releasing position and a locking position from outside said housing, and at least one grip each being coupled with said slider element for each pair of projections, said at least one grip having jaws receiving said pair of projections therebetween upon displacement of said slider element from said releasing position to said locking position.

2. An apparatus according to claim 1, wherein said jaws of said at least one grip are bevelled and have jaw lines forming an open wedge shape with an acute angle with one another as seen in the direction of movement into said locking position.

3. An apparatus according to claim 1, wherein said at least one grip is formed onto said slider element.

4. An apparatus according to claim 1, including at least one locking element being rotatably mounted on said housing and having ends, said at least one grip being formed onto one of said ends of said locking element, and a link disposed at said slider element for pivoting said at least one locking element into and out of said locking position.

5. An apparatus according to claim 4, wherein said at least one locking element has an axis of rotation extending in the direction of displacement of said slider element.

6. An apparatus comprising an optically transparent trough of an extended-field light, a housing, and a device for locking said trough to said housing, said trough and said housing each having a respective mutually parallel projection oriented in the same direction and disposed one above the other in an assembled condition of said trough and said housing forming at least one pair of projections, and said locking device including a slider element being displaceable in said housing between a releasing position and a locking position, and at least one grip each being coupled with said slider element for each pair of projections, said at least one grip having jaws receiving said pair of projections therebetween upon displacement of said slider element from said releasing position to said locking position.

* * * * *